US011235437B2

(12) United States Patent
Moos et al.

(10) Patent No.: US 11,235,437 B2
(45) Date of Patent: Feb. 1, 2022

(54) ROUGH GRINDING WHEEL COMPRISING A CORE

(71) Applicant: Klingspor AG, Haiger (DE)

(72) Inventors: Markus Moos, Haiger (DE); Bernd Conradi, Netphen-Hainchen (DE)

(73) Assignee: KLINGSPOR AG, Haiger (DE)

( * ) Notice: Subject to any disclaimer, the term of this patent is extended or adjusted under 35 U.S.C. 154(b) by 176 days.

(21) Appl. No.: 16/388,088

(22) Filed: Apr. 18, 2019

(65) Prior Publication Data

US 2019/0240809 A1 Aug. 8, 2019

Related U.S. Application Data

(63) Continuation of application No. 15/077,064, filed on Mar. 22, 2016, now abandoned.

(30) Foreign Application Priority Data

Apr. 2, 2015 (DE) ..... 102015004355.2

(51) Int. Cl.

| | |
|---|---|
| ***B24D 7/04*** | (2006.01) |
| ***B24D 7/18*** | (2006.01) |
| ***B24D 7/14*** | (2006.01) |
| ***B24D 3/28*** | (2006.01) |

(52) U.S. Cl.

CPC ..... *B24D 7/04* (2013.01); *B24D 3/28* (2013.01); *B24D 7/14* (2013.01); *B24D 7/18* (2013.01)

(58) Field of Classification Search

CPC ... B24D 7/14; B24D 7/18; B24D 7/04; B24D 3/28

USPC ..... 451/548

See application file for complete search history.

(56) References Cited

U.S. PATENT DOCUMENTS

| | | | | |
|---|---|---|---|---|
| 2010/0190424 | A1* | 7/2010 | Francois | B24D 5/123 451/548 |
| 2013/0305614 | A1* | 11/2013 | Gaeta | B24D 11/001 51/298 |
| 2015/0000206 | A1* | 1/2015 | Klett | B24D 11/02 51/298 |
| 2015/0375367 | A1* | 12/2015 | Sivasubramanian | B24D 3/28 51/296 |

* cited by examiner

*Primary Examiner* — Joseph J Hail
*Assistant Examiner* — J Stephen Taylor
(74) *Attorney, Agent, or Firm* — Quarles & Brady LLP

(57) ABSTRACT

A rough grinding wheel for processing material surfaces includes a wheel-shaped base body having a central recess penetrated by an axis of rotation for direct or indirect connection to a drive shaft of a tool. The rough grinding wheel has a stabilizing core stabilizing the rough grinding wheel. The stabilizing core is associated with at least one abrasive layer circumferentially adjacent to the central recess. The stabilizing core has a higher strength than the at least one abrasive layer.

13 Claims, 1 Drawing Sheet

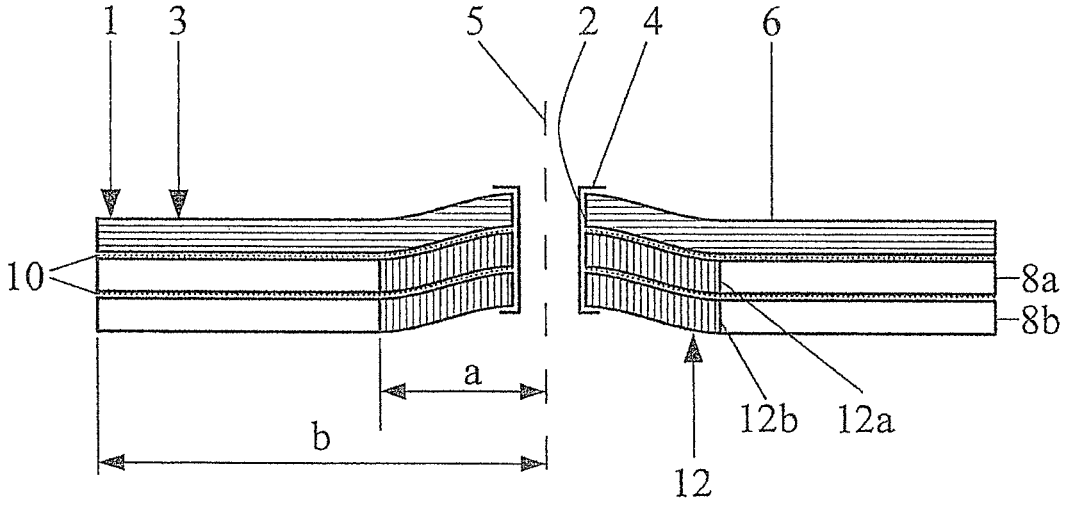
1
3
5
2
4
6
10
8a
8b
a
b
12b
12a
12

ROUGH GRINDING WHEEL COMPRISING A CORE

CROSS-REFERENCE TO RELATED APPLICATIONS

This application is a continuation of U.S. patent application Ser. No. 15/077,064 filed Mar. 22, 2016, which claims the priority benefit of German Patent Application No. 10 2015 004 355.2 filed Apr. 2, 2015. The contents of which is hereby incorporated by reference as if set forth in its entirety herein.

STATEMENT REGARDING FEDERALLY SPONSORED RESEARCH OR DEVELOPMENT

Not applicable.

FIELD OF THE INVENTION

The invention relates to a rough grinding wheel.

BACKGROUND OF THE INVENTION

A rough grinding wheel of this kind is known from practice and is suitable for rough grinding of material surfaces of various materials. It comprises a wheel-shaped base body comprising a central recess for direct or indirect connection to a drive shaft of a tool. The central recess is penetrated by an axis of rotation. Furthermore, the base body comprises at least one abrasive layer.

The rough grinding wheel known to date does not exhibit satisfactory stability in particular at high speeds. A stable rough grinding wheel is a rough grinding wheel that stays stiff even at high contact pressure. A stable rough grinding wheel is easy to control, making it possible to achieve a defined or high stock removal rate.

SUMMARY OF THE INVENTION

The invention is based on the object of providing a rough grinding wheel of the kind mentioned above that is characterized by an improved structure and that in particular exhibits improved stability. This object is attained in an embodiment of the invention by the rough grinding wheel disclosed herein.

The rough grinding wheel according to the invention comprises a wheel-shaped base body comprising a central recess penetrated by an axis of rotation for direct or indirect connection to a drive shaft of a tool and comprising at least one abrasive layer. The rough grinding wheel according to the invention is characterized by a stabilizing core for stabilizing the rough grinding wheel, said stabilizing core being associated with the at least one abrasive layer and being circumferentially adjacent to the central recess. Furthermore, the stabilizing core has higher strength than the at least one abrasive layer.

Compared to the known rough grinding wheel, the stability can be further adapted and improved by using a core within the rough grinding wheel. This is because the core serves to stabilize the rough grinding wheel while the latter rotates.

Especially in the area of the central recess, where stresses due to the grinding process, such as rotation forces and lateral loads, concentrate, the stabilizing core can optimize the rough grinding wheel in terms of its stability without affecting the abrasive areas, the abrasive mixtures or the strength of the rough grinding wheel. This is because the stabilizing core absorbs forces acting on the at least one abrasive layer during grinding and transmits them evenly to the drive shaft of the tool. In the same way, the stabilizing core evenly transmits the forces exerted by a user to the at least one abrasive layer via the drive shaft of the tool. Thus, the stabilizing core additionally serves as a force transmission element between the at least one abrasive layer and the connection to a drive shaft of a tool. The advantages of the rough grinding wheel according to the invention rest both in the concentration of mass in the area of its center of rotation and in the indirect transmission of forces between the at least one abrasive layer and the drive shaft of the tool. In this way, the rough grinding wheel stays stable and easily controllable at all times even in case of high applied forces and contact pressures and/or at high speeds.

In a preferred embodiment of the rough grinding wheel according to the invention, a ratio of the outer radius of the stabilizing core to an outer radius of the rough grinding wheel is between 2:50 and 25:50. Preferably, the ratio is 17:50. This ratio leads to optimal stability and to a largest possible abrasive surface at the same time.

It is conceivable that the base body has at least two abrasive layers, a separating layer being arranged between adjacent abrasive layers. In this way, advantages arise in combination with the stabilizing core compared to known rough grinding wheels for the case in which both stability and strength of the rough grinding wheel are to be optimized. This is because in a known rough grinding wheel, one tries to compensate an adaption and improvement of stability and strength by means of separating layers arranged between individual abrasive layers. However, this leads to a target value conflict between stability and strength because these two target values influence each other. Compared to the known rough grinding wheel, further adaption and improvement of stability and strength can be achieved separately by using a core in combination with separating layers. This is because the core serves to stabilize the rough grinding wheel while the latter rotates. The separating layer, on the other hand, benefits the strength of the rough grinding wheel. In this way, both target values can be optimized or maximized independently of each other so as to ensure improved product properties.

The abrasive layers may contain various fillers and additives. The abrasive layers may comprise abrasive grits, such as regular brown fused alumina and derivatives, blue fired alumina, white fused alumina, zirconia alumina, silicon carbide, ceramic grain, pink fused alumina and/or monocrystalline alumina. Furthermore, the abrasive layers may comprise supporting fillers, such as polyaluminum fluoride, cryolite, pyrite, calcite, wollastonite and/or graphite, which may be bonded by means of phenolic resin systems.

Furthermore, a core segment defining the stabilizing core can be associated with at least one of the abrasive layers. In this way, it is possible to form the rough grinding wheel in layers without forgoing the advantages of the invention. In this embodiment, at least one separating layer thus extends from the recess or from a hub to the outer edge of the rough grinding wheel. The individual cores segments are connected to each other either directly via recesses in the corresponding separating layer or indirectly via the corresponding separating layer. An abrasive layer and a cores segment associated with the corresponding abrasive layer are arranged between adjacent separating layers. The stability of the rough grinding wheel is ensured in that the individual cores segments together benefit the strength of the rough grinding wheel and define the stabilizing core.

Other advantages and advantageous embodiments of the subject-matter of the invention can be taken from the description, the drawing and the claims.

An embodiment example of a rough grinding wheel according to the invention is illustrated in the drawing in a schematically simplified manner and will be explained in more detail in the following description.

BRIEF DESCRIPTION OF THE DRAWINGS

FIG. 1 shows a section through a rough grinding wheel incorporating the present invention.

DETAILED DESCRIPTION OF THE EXAMPLE EMBODIMENTS

The rough grinding wheel 1 illustrated in the drawing comprises a base body 3 having a layered structure. The base body 3 comprises a central recess 2 penetrated by an axis of rotation 5 located in the center of rotation of the rough grinding wheel 1. An insert 4 for attaching the rough grinding wheel 1 to a drive shaft of a tool is arranged in the recess 2. A reinforcing layer 6 is arranged on the tool side of the rough grinding wheel 1 facing toward the tool. The reinforcing layer 6 may comprise rutile, wollastonite, calcite and/or basalt, which may be phenolic resin-bonded. A grain size may be between 0.1 mm to 1.0 mm, preferably between 0.2 mm and 0.5 mm. Furthermore, the reinforcing layer 6 may comprise quartz sand. Thus, the reinforcing layer 6 has high strength. It may comprise a net-like interlining in order to further increase the stability of the rough grinding wheel 1.

Furthermore, the rough grinding wheel 1 comprises two abrasive layers 8*a*, 8*b* arranged on the side facing away from the tool side of the reinforcing layer 6. The abrasive layers 8*a*, 8*b* may comprise abrasive grits, such as regular brown fused alumina and derivatives, blue fired alumina, white fused alumina, zirconia alumina, silicon carbide, ceramic grain, pink fused alumina and/or monocrystalline alumina. Furthermore, the abrasive layers may comprise supporting fillers, such as polyaluminum fluoride, cryolite, pyrite, calcite, wollastonite and/or graphite, which may be bonded by means of phenolic resin systems. Thus, a phenolic resin/abrasive grain mixture is formed, which may contain various fillers and additives. A separating layer 10 is arranged between the two abrasive layers 8*a*, 8*b*. Furthermore, another separating layer 10 is arranged between the reinforcing layer 6 and abrasive layer 8*a*. Each of the separating layers 10 is formed by a glass tissue layer and benefits the strength of the rough grinding wheel 1. The separating layers 10 extend from an outer edge of the rough grinding wheel 1 to the central recess 2 and annularly surround the central recess 2.

Furthermore, the rough grinding wheel 1 comprises a stabilizing core 12 surrounding the axis of rotation 5 of the rough grinding wheel 1 and being adjacent to the central recess 2 and, in sections, forming the edge of the central recess 2. The stabilizing core 12 may comprise rutile, wollastonite, calcite and/or basalt, which may be phenolic resin-bonded. A grain size may be between 0.1 mm to 1.0 mm, preferably between 0.2 mm and 0.5 mm. Furthermore, the reinforcing layer 6 may comprise quartz sand. The stabilizing core 12 has higher strength than the abrasive layers 8*a*, 8*b*. The stabilizing core 12 is formed by two core segments 12*a*, 12*b* and serves as a force transmission element between the two abrasive layers 8*a*, 8*b* and the connection to the drive shaft of the tool.

A core segment 12*a*, 12*b* of the stabilizing core 12 is associated with each abrasive layer 8*a*, 8*b*. Core segment 12*a* is arranged between two separating layers 10 adjacent thereto. Core segment 12*b* is adjacent to a separating layer 10 at the tool side and is open, i.e. not covered by a separating layer 10, at the side facing the work piece. In consequence, the separating layers 10 divide the stabilizing core 12 into two core segments 12*a*, 12*b*. The two adjacent core segments 12*a*, 12*b* are connected to each other via the interposed separating layer 10 and define the stabilizing core 12.

The outer radius a of the stabilizing core 12 has a ratio of 17:50 to the outer radius b of the rough grinding wheel 1. Furthermore, the stabilizing core 12 has a constant radius across its thickness and in the axial direction of the rough grinding wheel 1.

To ensure an optimal connection to a tool, the central recess 2 is realized as a recessed hub.

The invention claimed is:

1. A rough grinding disk comprising:

a disk-shaped base body comprising a central recess and further comprising a reinforcing layer;

at least two abrasive layers supported by the reinforcing layer; and a stabilizing core associated with the abrasive layers, circumferentially adjacent the central recess and having a higher strength than the abrasive layers, the stabilizing core comprising at least two core segments, the at least two core segments corresponding to and having the same thickness as the associated abrasive layers, wherein a separating layer is arranged between the abrasive layers and the corresponding core segments, the separating layer extending continually along a length of the abrasive layers and corresponding core segments, wherein the core segments define the stabilizing core and are separated by the separating layer.

2. The rough grinding disk according to claim 1, in which a ratio of an outer radius of the stabilizing core to an outer radius of the rough grinding wheel is between 2:50 and 25:50.

3. The rough grinding disk according to claim 2, in which the ratio of the outer radius of the stabilizing core to the outer radius of the rough grinding wheel is about 17:50.

4. The rough grinding disk according to claim 1, in which the stabilizing core has a constant outer radius across its thickness.

5. The rough grinding disk according to claim 1, in which the stabilizing core is continuous around the central recess.

6. The rough grinding disk according to claim 1, in which the central recess is a recessed hub.

7. The rough grinding disk according to claim 1, in which the at least two abrasive layers include abrasive grits.

8. The rough grinding disk according to claim 7, in which the abrasive grits is selected from a group consisting of regular brown fused alumina and derivatives, blue fired alumina, white fused alumina, zirconia alumina, silicon carbide, ceramic grain, pink fused alumina, and monocrystalline alumina.

9. The rough grinding disk according to claim 7, in which the abrasive grits includes supporting fillers selected from a group consisting of polyaluminum fluoride, cryolite, pyrite, calcite, wollastonite, and graphite.

10. The rough grinding disk according to claim 7, in which the abrasive grits is bonded by a phenolic resin system.

11. The rough grinding disk according to claim 1, in which the at least one separating layer includes a glass fabric.

12. The rough grinding disk according to claim 1, wherein an axis of rotation for direct or indirect connection to a drive shaft of a tool extends through the central recess.

13. The rough grinding disk according to claim 1, wherein the stabilizing core comprises phenolic resin-bonded rutile, wollastonite, calcite, and basalt.

* * * * *